United States Patent [19]

Eubank

[11] Patent Number: 4,921,577

[45] Date of Patent: May 1, 1990

[54] METHOD FOR OPERATING A WELL TO REMOVE PRODUCTION LIMITING OR FLOW RESTRICTIVE MATERIAL

[76] Inventor: Dennis R. Eubank, 8639 Richardson Branch Trail, Dallas, Tex. 75243

[21] Appl. No.: 227,148

[22] Filed: Aug. 2, 1988

[51] Int. Cl.[5] ..... E21B 37/00; E21B 21/00

[52] U.S. Cl. ..... 166/311; 166/312; 166/370

[58] Field of Search ..... 166/312, 311, 313, 370, 166/115-117, 177, 99, 158, 164, 165, 169

[56] References Cited

U.S. PATENT DOCUMENTS

| | | | |
|---|---|---|---|
| 1,649,865 | 11/1927 | Sites | 166/105.2 |
| 1,832,323 | 11/1931 | Rigby | 166/108 |
| 2,782,860 | 2/1957 | Tausch et al. | 166/312 X |
| 2,852,078 | 9/1958 | Krause, Jr. | 166/312 |
| 3,020,958 | 2/1962 | Kenneday | 166/312 X |
| 3,033,289 | 5/1962 | Moore | 166/312 |
| 3,279,543 | 10/1966 | Yetman | 166/312 X |
| 3,561,534 | 2/1971 | Dendy | 166/311 |
| 3,572,431 | 3/1971 | Hammon | 166/99 |
| 4,060,130 | 11/1977 | Hart | 166/312 |
| 4,211,280 | 7/1980 | Yeates | 166/311 |
| 4,301,868 | 11/1981 | Scherubel et al. | 166/308 |
| 4,450,907 | 5/1984 | Clark et al. | 166/312 X |
| 4,557,837 | 12/1985 | Clark, III et al. | 166/308 X |

OTHER PUBLICATIONS

Uren, L. C., Petroleum Production Engineering-Oil Field Exploitation, "Methods of Removing Detrital Accumulations within the Oil String," McGraw-Hill, Third Edition, 1953, pp. 405-409.

Journal of Petroleum Technology, Aug. 1987, p. 879, "New Sand Control Technology Helps Maximize Earnings at Today's Oil Prices".

*Primary Examiner*—Hoang C. Dang

*Attorney, Agent, or Firm*—Richards, Medlock & Andrews

[57] ABSTRACT

A method and downhole well installation for facilitating the removal of detrimental material such as sand accumulated within a well penetrating a subterranean hydrocarbon formation. A tubing string in the well extends to a production interval open to the formation. A production stinger is slidably disposed in the tubing string and extends downwardly from the bottom of the tubing string into the production interval. A seal is provided between the stinger and the tubing string which permits slidable movement of the stinger but provides for a seal against fluid flow upwardly in the stinger-tubing string annulus. A longitudinal passage extends through the stinger and opens into the tubing string above the seal. At least one inflow opening to the longitudinal passage is provided in the stinger near the bottom thereof. Thus, when the stinger comes to rest upon the sand or other unwanted material accumulated in the well, the inflow opening is located adjacent the surface of the unwanted material. A pressure gradient is established through the inflow opening into the stinger passage. Fluid such as gas from the formation flows through the inflow opening into the longitudinal passage and entrains particulate material and carries it to the stinger passage to form a fluid stream containing entrained particulate material. The fluid-particulate material mixture passes upwardly through the stinger passage and into the tubing string above the seal.

27 Claims, 4 Drawing Sheets

FIG. 3
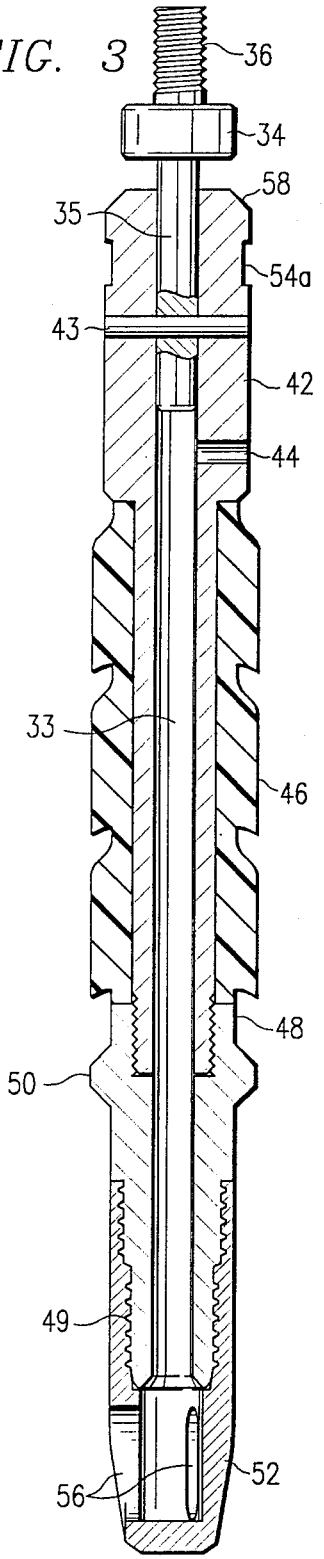
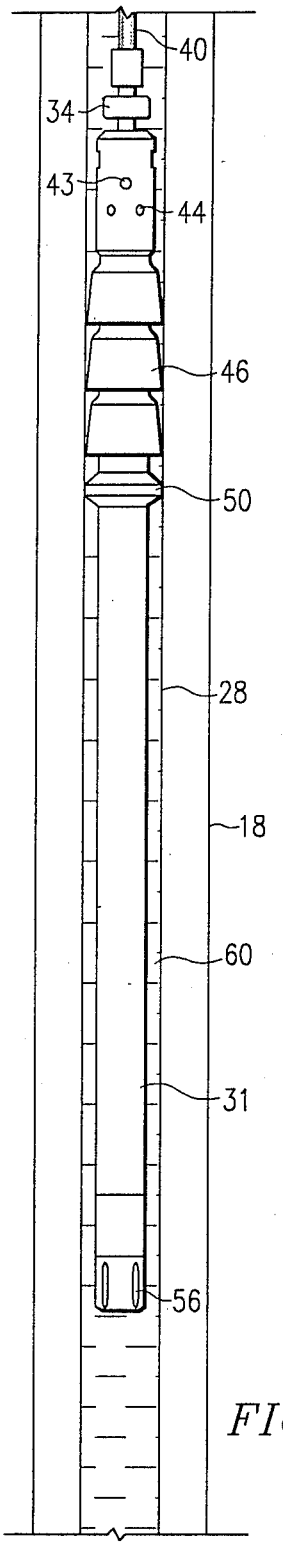
FIG. 4

METHOD FOR OPERATING A WELL TO REMOVE PRODUCTION LIMITING OR FLOW RESTRICTIVE MATERIAL

FIELD OF THE INVENTION

This invention relates to the production of wells subject to the accumulation of material which is damaging, flow restrictive or otherwise detrimental to the operation of the wells and more particularly to downhole well installations and tools for removal of such detrimental material and processes for operating such wells.

BACKGROUND OF THE INVENTION

In the petroleum industry, wells for the production of fluids from subterranean hydrocarbon bearing formations are often completed in formations which are partially or even completely unconsolidated, thus resulting in the flow of particulate materials such as sand grains into the well where they accumulate. In other cases, the productive formation may be characterized by good cementation, but unwanted particulate materials may accumulate in the well as a result of treatment procedures which are carried out to increase the gross permeability or flow capacity of the formations.

Conventional well treatment procedures include hydraulic fracturing and acidizing. Hydraulic fracturing involves the injection of a hydraulic fracturing fluid into the well, and the imposition of sufficient pressure on the fracturing fluid to cause the formation to mechanically break down with the attendant formation of one or more fractures. The fractures formed may be horizontal or vertical with the later usually predominating and with the tendency toward vertical fracturing orientation increasing with the depth of the formation being treated. Simultaneously with or subsequently to the formation of a fracture at least a portion of the fracturing fluid comprising a thickened carrier fluid having a propping agent such as sand or other particulate material entrained therein is introduced into the fracture. The propping agent is deposited in the fracture and functions to hold the fracture open after the pressure is released and the fracturing fluid produced back into the well.

Another effective procedure for increasing the gross or apparent permeability of a subterranean hydrocarbon bearing formation is acidizing. In acidizing, an aqueous solution of a suitable acid is injected into the well and forced into the surrounding formation where it dissolves acid soluble material therein to form relatively small fissures or fractures. Acidizing procedures are usually applied to carbonate containing formations and suitable acids for use in such formations include hydrochloric, formic and acidic acids. In some cases, however, sandstones containing little or no carbonate materials may be treated with acids such as hydrochloric or hydrofluoric acids or blends thereof.

Acidizing and mechanical fracturing also may be applied in a common procedure in which an acidizing fluid, usually in the form of a relatively low viscosity "spearhead," is injected into the well under sufficient pressure to break down the formation and produce fractures by hydraulic fracturing. The spearhead fluid may be followed by a higher-viscosity fluid containing a propping agent, which may be an acidic or a conventional non-acidic fracturing fluid.

In such fracturing processes, it is sometimes expedient to employ a fluid loss additive in all or part of the fracturing fluid. In hydraulic fracturing, the fluid loss additive functions to minimize loss of fracturing fluid into the formation as the formation breakdown pressure is reached, thus aiding in initiation of the fracture. Also, as the fracture is formed, fracture propagation outwardly into the formation is enhanced since the fluid loss additive functions to decrease filtrate loss through the walls of the fracture into the formation matrix.

Treating or stimulating procedures such as those described above often times result in an accumulation of unwanted particulate material in the bottom of the well. For example, some propping sand may settle out of the fracturing fluid as it is forced from the well into the formation. Lost circulation material may likewise sometimes accumulate in the bottom of the well. Also, at the conclusion of the fracturing procedure, a substantial quantity of propping sand is produced back from the formation into the well where it accumulates. The use of acidizing fluids may also result in the accumulation of unwanted materials within the well. For example, an acidizing fluid may react with various metallic materials to produce precipitates or gel-like flocculants which gather in the well.

The flow of unwanted particulate materials into a well and/or the accumulation of such detrimental materials therein can present a number of problems. In the case of gas wells, sand material may flow into the well through perforations or liner slots in the form of high velocity jets which can lead to errosion of downhole well equipment. Often times gas wells are completed in a manner in which a single production interval of the well is open to a plurality of gas sands, permitting for co-mingled production from the several sands through a single tubing string. Detrimental material flowing into the well tends to accumulate in the bottom of the production interval, thus restricting production from the lower sands. This problem can be particularly pronounced when the well is placed on production after stimulation with a procedure such as acidizing or hydraulic fracturing. Especially in the case where an accumulated sand column contains produced liquids or liquids used in stimulation, the flow of fluid from the formation into the bottom of the well can be all but stopped.

Similar difficulties may be encountered where only one producing horizon is involved. Here, the problem can be exacerbated by the fact that the closing off of perforations in the lower portion of the producing zone will cause the gas entering the well from the remaining open perforations to be at even a greater velocity than would otherwise be the case, thus further causing errosion of any downhole well equipment which may be subject to the blast zone conditions.

While serious sanding problems are most often encountered in conjunction with gas productions, they may also occur in the case of oil production. In this case, sand entrained in the oil can cause damage to downhole equipment such as the standing and traveling valve units of a sucker rod pumping unit. Sand can also actually accumulate about the pump, or the gas anchor, if any, associated with the pump, restricting the flow of fluids into the pump barrel.

Various method have been proposed for the removal of accumulated detrital material from a well. For example, as disclosed in Uren, L. C. *Petroleum Production Engineering - Oil Field Exploitation*, "Methods of Removing Detrital Accumulations within the Oil String,"

McGraw-Hill, Third Edition, 1953, pp. 405–409, a bailer may be lowered into the well to mechanically lift sand from the well. Another procedure involves lowering the tubing string until it is just above the column of accumulated detrital material and then circulating oil down through the tubing with a return of oil and entrained sand through the tubing-casing annulus. As the detrital material is removed, the tubing is gradually lowered until the bottom is reached. Another procedure involves circulation of compressed air or gas down through the tubing together with a small amount of water and oil. The tubing is lowered into the accumulated detrital material which is returned to the surface through the tubing-casing annulus by the action of the rapidly expanding gas as it flows upwardly through the annulus.

U.S. Pat. No. 3,572,431 to Hammon discloses an apparatus for retrieving downhole material such as various pieces of junk, debris and the like or accumulated mud and sand. In Hammon, the retrieval apparatus is attached to the lower end of a pipe string and introduced into the bottom of the well adjacent the accumulated debris, sand or mud. The Hammon apparatus comprises a hollow cylindrical body which includes a cylindrical basket of reduced dimension to define a space between the exterior of the basket and the internal cylindrical body. A catcher assembly, including pivoted flaps, is located near the bottom of the basket, immediately above a plurality of teeth formed at the extreme lower end of the external cylindrical member. Fluid is circulated down the annulus surrounding the drill pipe and passes up through the lower opening and catcher assembly into the interior of the basket and then into the interior passage of the pipe. Accumulated debris is held in the basket by the catcher assembly. After the basket is filled, circulation can still be maintained through the basket annulus in order to clean out sand, mud and the like at the bottom of the well.

U.S. Pat. No. 4,211,280 to Yeates discloses a completion tool which involves a tubular nipple unit including an optional catcher sub having side production apertures and a hydraulic pressure relief port at the bottom. The unit is run into the well at the lower end of a tubing string with an ejectable surge plug in place above the production apertures. A drop bar is employed to eject the surge plug from the nipple into the optional catcher sub. Ejection of the surge plug causes a rapid pressure differential causing fluid and debris within the well bore to surge upwardly within the tubular member.

SUMMARY OF THE INVENTION

The present invention provides a new and advantageous method and well installation for the operation of a well having a column of accumulated flow restricting material within the bottom of a production interval open to a subterranean formation through which gaseous fluids are produced. In carrying out one aspect of the invention, a longitudinal flow passage is established within the well. The flow passage extends into the production interval through a seal above the production interval. A pressure gradient is established from the production interval into the longitudinal flow passage through an inflow opening. The inflow opening places the passage in fluid communication with the production interval of the well at a location adjacent the upper surface of the column of accumulated particulate material. Gaseous formation fluid flows under the pressure gradient through the inflow opening into the longitudinal flow passage. The gaseous formation fluid entrains the detrimental particulate material and carries it through the inflow opening into the longitudinal passage to form an upwardly flowing fluid stream containing entrained particulate material. The fluid-particulate material mixture passes upwardly through the longitudinal flow passage and into the well above the seal.

In a preferred embodiment of the invention, turbulent flow conditions are established at a location adjacent the inflow opening in order to facilitate the gaseous fluid picking up the sand or other detrimental material and carrying it into the elongated passageway. As the accumulation of unwanted material in the production interval is decreased, the inflow opening into the flow passage is progressively lowered to maintain the inflow opening adjacent the surface of the column of material.

The invention further comprises a downhole well installation which facilitates the removal of accumulated detrimental material within a well production interval. The installation comprises a tubing string in the well extending to the production interval. A production stinger is slidably disposed in the tubing string and extends downwardly from the bottom of the tubing string into the production interval. A seal is provided between the stinger and the tubing string. The seal permits slidable movement of the stinger relative to the production string but provides for a seal against fluid flow upwardly in the stinger tubing string annulus. A longitudinal passage extends through the stinger and opens into the tubing string above the seal. At least one inflow opening to the longitudinal passage is provided in the stinger near the bottom thereof. Thus, when the stinger comes to rest upon the unwanted particulate material accumulated in the well, the inflow opening is located adjacent the surface of the particulate material.

Another embodiment of the invention involves a method of producing a well penetrating a gas-bearing formation. The well may be completed with a packer set above the production interval open to the formation. A tubing string extends through the packer. The well is operated to produce gaseous fluid from the well with the flow of the gaseous fluid causing the accumulation of detrimental material in the production interval of the well. The well is shut-in and liquid is injected into the well in sufficient amount to load at least a portion of the tubing with the shut-in liquid. An elongated production stinger is then run into the well by lowering the production stinger through the tubing string on any suitable running in system such as a sand line or the like. As the stinger is lowered through the tubing, a sliding seal is provided between the stinger and the tubing string. The stinger is provided with a longitudinal passage which provides for liquid flow through the passage from below to above the seal. Thus, as the stinger is lowered through the tubing, pressure equalization is achieved above and below the seal. The stinger is lowered until the lower portion thereof projects through the tubing string and into contact with the column of detrimental material to place an inflow opening adjacent the surface of the detrimental material. The liquid previously introduced to the well is removed and the well placed on production to cause gas to flow from the formation into the well production interval and thence into the inflow opening where it entrains the detrimental material as described previously.

Yet another embodiment of the invention provides a preferred form of through tubing production stinger which comprises an elongated tubular member having an internal passageway extending longitudinally thereof and being at least partially closed at the lower end thereof. At least one inflow opening is provided adjacent the lower end of the tubular member. Means are provided adjacent the upper end of the tubular member for releasably connecting the tubular member to a running in tool. Sealing means are secured to the tubular member above the inflow opening which are adapted to engage the internal surface of a tubing string in a slidable sealing relationship. An equalizing port is provided above the sealing means, and an upset shoulder is provided on the tubular member below the sealing means which functions to engage a landing nipple within the tubing string.

BRIEF DESCRIPTION OF THE DRAWINGS

FIG. 3 is a side elevation in section, showing details of stinger assembly of FIG. 2; and FIGS. 4, 5, 6 and 7 are schematic illustrations of a well illustrating the practice of the present invention to remove detrimental material from a well.

DETAILED DESCRIPTION

Figure 1:
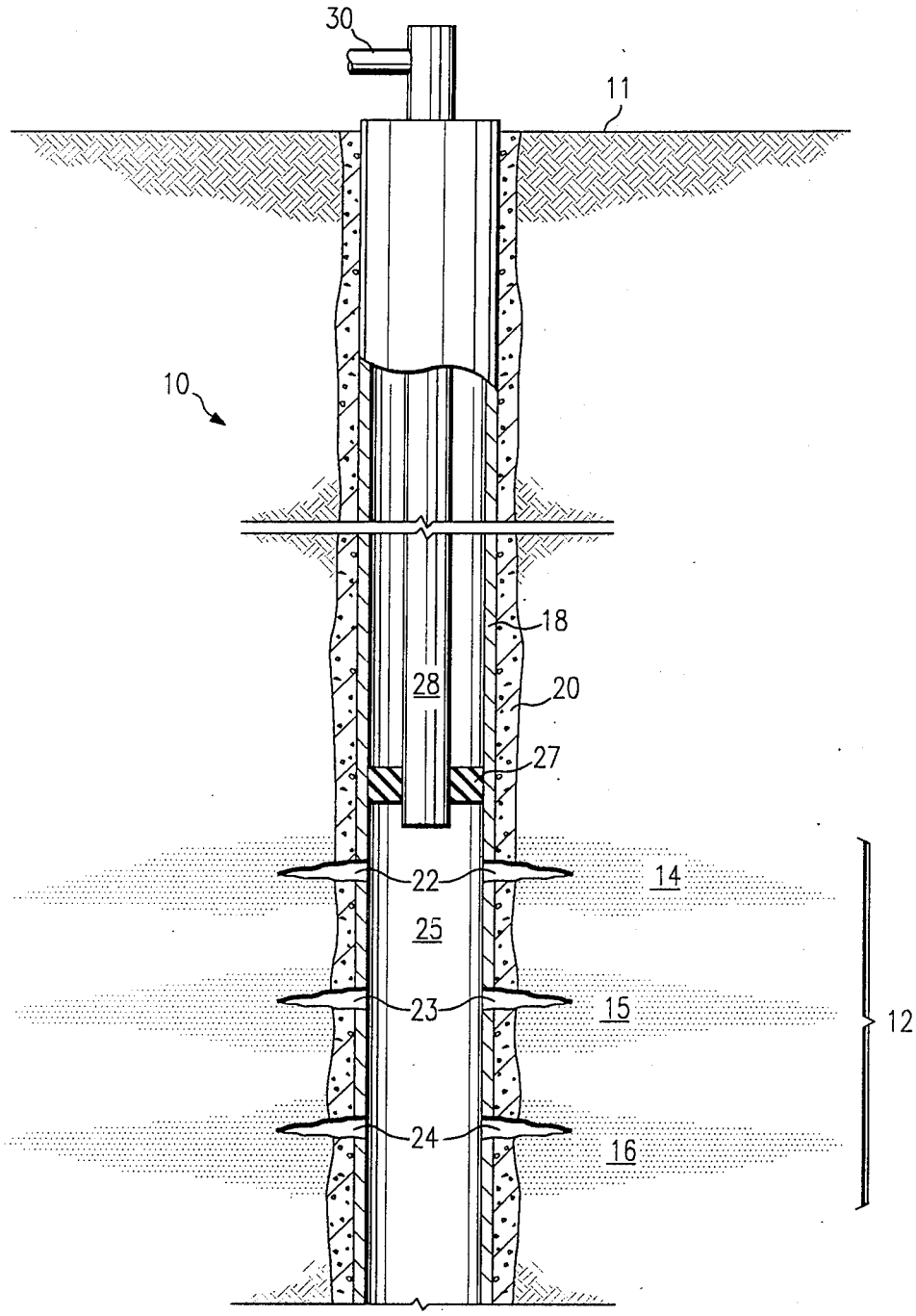
FIG. 1 is an illustration, partly in section showing a well installation in which the invention can be used.

FIG. 1 illustrates an exemplary well installation in which the present invention may be employed. More particularly and with reference to FIG. 1, there is illustrated a well bore 10 which extends from the surface 11 of the earth and penetrates a productive horizon 12 comprising one or more subterranean hydrocarbon bearing formations. In the exemplary illustration of FIG. 1, the productive horizon comprises a plurality of more or less discrete gas sands 14, 15 and 16 separated by intervening shale stringers. In this case, the productive horizon may be relatively thick with the top of the upper-most sand 14 and the bottom of the lower most gas sand 16 defining an interval of several hundred feet or more. Alternatively, a single unitary formation may be involved in which case the productive horizon usually will involve a smaller vertical interval.

The well typically will be provided with at least one casing string 18, commonly referred to as an oil string, which is cemented in the well. The casing and the surrounding cement sheath 20 are provided with a plurality of perforations 22, 23 and 24 which define a production interval 25 through which the well is open to the reservoir for the production of fluids. Although in most wells, the production interval will be provided by a plurality of circular perforations and produced by jet or gun-perforation techniques, the production interval of a well may be provided by so-called "shop perforated" pipe or a slotted liner in which openings are formed prior to insertion of the pipe or liner into the well. Other procedures may be employed to open the well to the flow. For example, in rare instances the casing may be set to the top of the productive horizon and then drilled out to provide an open hole completion. The term "production interval" is used herein and in the appended claims to cover all such means of opening a well to the flow of fluids from an adjacent subterranean formation.

The well is provided with a packer 27 located above the top of the upper gas sand 14. The well is also provided with a tubing string 28 which extends from the well head through the packer 27 and into the production interval 25. In the case of a gas well, the tubing string normally will be landed to a point above the upper-most perforations. However, the tubing string may extend in some cases to a lower location. In any case, fluids from the productive horizon flow into the well and are produced through the interior of the tubing string 28 to the well head where they are passed into a suitable gathering line 30.

In the following discusion it will be assumed that the producing horizon is a gas reservoir, either of a number of discrete gas sands as indicated in FIG. 1 or a single, unitary formation. In either case, the produced fluids usually will be predominantly gaseous fluids comprising natural gas and condensate which may be produced with or without accompanying liquid. In many instances, such gas production is accompanied by water production. Also, the productive horizon may take the form of an oil and gas reservoir in which oil may be produced from lower perforations with gas production occurring primarily through upper perforations. In such situations, substantial amounts of water may also be produced usually with the oil or possibly at a location below the oil production.

Returning to FIG. 1, relatively fine sand grains entrained in gas flowing into the well will in some cases be carried to the surface through the tubing string 28. However, in many cases, particularly where coarser grains are involved, particulate material will fall out of the produced fluid and tend to settle in the well resulting in a sanding up condition which will progressively cover the perforations from the bottom. Such sanding up conditions are particularly pronounced where steps are taken to increase the productivity of the well by the injection of stimulating fluids. As noted previously, such procedures which are commonly employed to increase the gross permeability or flow capacity of relatively tight gas sands (and other hydrocarbon bearing formations) involve hydraulic fracturing and acidizing. In both procedures, the treating fluid, fracturing liquid containing sand propping agent or aqueous acid solution, usually hydrochloric acid, are injected into the formation under applied pressure, and the pressure gradient then reversed to produce the treating fluids from the formation back into the well.

In carrying out such stimulating procedures, it sometimes happens that the treating fluids preferentially enter certain "less restrictive" perforations with the remaining "more restrictive" perforations receiving little or no treating fluid. In such circumstances, it is a conventional expedient to introduce spherical sealing elements, commonly referred to as "ball sealers" into the treating fluid. The ball sealers tend to follow the flow of fluid into the perforations accepting fluids and are seated there to divert additionally injected fluid into the other perforations. At the conclusion of the treating process, the ball sealers normally remain in the well as debris.

Not only is increased sand accumulation in the well often encountered at the aftermath of a stimulation procedure, but also the accompanying liquid in the column of accumulated sand or other particulate material usually functions to block off the lower perforations even more effectively than if only sand were present.

Figure 2:
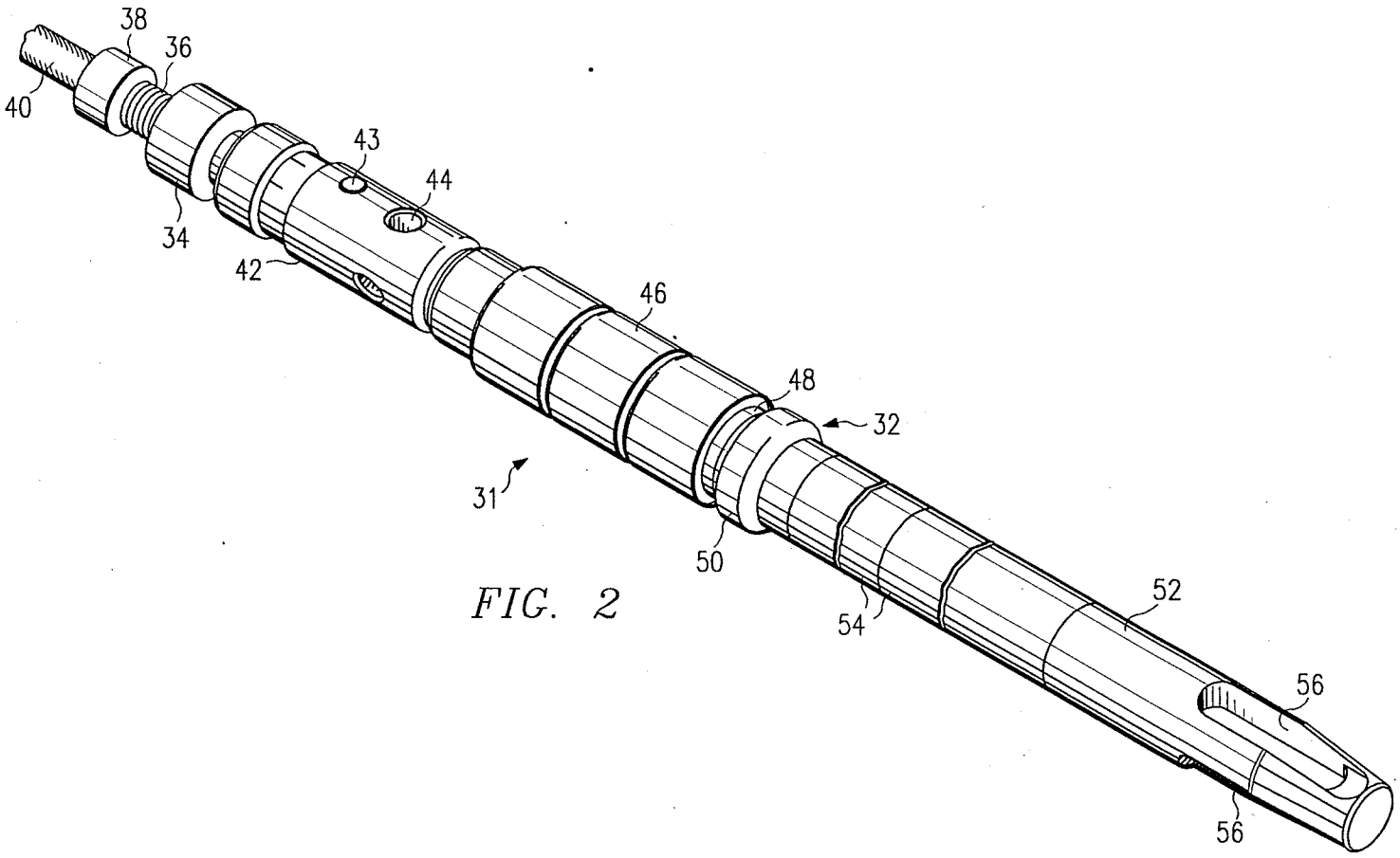
FIG. 2 is a perspective view of a production stinger embodying the present invention.

Turning now to FIG. 2, there is illustrated a perspective view of a through-tubing production stinger 31 embodying one aspect of the invention and which may be used in carrying out the process of the present invention. FIG. 2 shows the stinger in an assembled state as it would be run into the well. The production stinger comprises an elongated tubular member 32 which is adapted to be inserted into the well tubing string and which comprises a plurality of subs and tubing joints as described in greater detail below. A detachable member 34 is located at the upper end of the tubular member and comprises a threaded pin 36 which, as shown, is threaded into a box coupling 38 secured at the lower end of a sand line 40 or other suitable cable which can be used to lower the stinger through the well. The detachable connecting sub 34 is secured into the upper end of an equalizing sub 42 by means of a shear pin 43 as described in greater detail hereinafter. Equalizing sub 42 forms the upper portion of the elongated tubular member and is provided with one or more equalizing ports 44 which extend into the interior bore of the tubular member 32. As a practical matter, it usually will be preferred to use 3 or 4 equalizing ports spaced at 120° or 90°, respectively. The equalizing sub also carries a sealing member 46 which functions, as the stinger is run into the well, to provide a sliding seal with the interior wall of the tubing string. As described in greater detail below, the sealing member preferably provides a plurality of inverted cup seals such as swab cups or the like which respond to upwardly imposed pressure within the well to form a good sealing seat with the interior of the tubing.

The portion of the tubular member immediately below the sealing member is provided by a landing sub 48 which is threadedly secured to a lower threaded pin formed at the lower end of the equalizing sub. The landing sub is provided with an annular upset shoulder 50 which is adapted to engage a landing seat within the tubing string to prevent the stinger from being lowered completely out of the tubing string. Shoulder 50 also shields sealing member 46, as described later. It will be recognized that portions of the tubular stinger member 32 can be formed integrally. However, the modular assembly is desirable since it permits the landing sub to be unthreaded from the equalizing sub to facilitate replacement of the sealing member. The remainder of the tubular member comprises a nose sub 52 and such intervening tubing joints 54 as are necessary to extend the production stinger to its desired length. In this respect, the overall length of the production stinger may extend to 400–500 feet or even more in order to accommodate its use in relatively thick production intervals of the type contemplated by the well installation shown in FIG. 1.

The nose sub 52 is provided with one or more inflow openings 56 adjacent the lower end thereof. The nose sub will normally be closed at the bottom as described below in order to prevent the production stinger from sinking into the accumulated particulate material within the well and to prevent plugging of the stinger during production. In the embodiment illustrated, three inflow openings spaced at 120° are provided. The inflow openings preferably are of a non-circular configuration so that when the tool is run after a stimulation procedure using ball sealers, the ball sealers will not seat and close the inflow openings. Preferably, the inflow openings are of a vertically elongated configuration as shown in order to provide a margin of error in arriving at an inflow opening immediately adjacent the top of the accumulated detrimental material even if the nose sub should sink partially into the detrital material.

In an actual production stinger embodying the present invention, a 1 $\frac{5}{8}$" O.D. nose sub is employed. The nose sub can be slightly tapered at its lower end as shown in FIG. 2 to an outer diameter at its bottom of about 1 $\frac{1}{8}$". The closure plate 53 as seen in FIG. 3, at the bottom is about $\frac{1}{4}$" thick. Alternatively, the nose sub can be a cylindrical member which is not tapered as shown in FIG. 4, described hereafter. This is advantageous in that it decreases the tendency of the stinger to penetrate the column of particulate material. Three slots of a width of about $\frac{1}{2}$" and length of about 1 $\frac{5}{8}$" are formed in the nose sub extending upwardly from the closure plate. Other slot configurations can, of course, be employed but it usually will be preferred to provide that the length of the slots are at least twice the width thereof.

The production stringer of FIG. 2 can be run into the well using conventional workover rigs such as rod or tubing pulling units. In running in the production stinger, the nose sub 52 is secured to the bottom of a stand of tubing and run into the well with such additional stands, usually in lengths of 30, 60 or 90 feet, being added as necessary to bring the production stinger to its desired length. Thereafter, the landing section and the remainder of the tubular member is secured to the top of the upper most tubing stand, and the stinger lowered to the production horizon on a flexible cable such as a sand line or the like. When the production stinger reaches bottom, as evidenced by loss of tension in the running-in line, the detachable section can be released by an upward jerk on the line to shear pin 43 and the well thereafter placed on production.

FIG. 3 is a side elevation, partially in section, of the production stinger of FIG. 2, showing certain features thereof in greater detail. In FIG. 3, the nose sub 52 is shown as being threaded directly onto the pin 49 of the landing sub 48. This arrangement is suitable for transporting the production stinger to the well site. In use, however, one or more intervening tubing sections will be provided as described above.

As shown in FIG. 3, the detachable upper member 34 comprises the threaded pin 36 which is adapted to be received in any suitable running-in tool, and a reduced cylindrical section 35 which fits into the bore of equalizing sub 42 and is secured thereto by means of the shear pin 43. A longitudinal flow passage 33 extends through the stinger from the bottom to the top of the tubular member. Closure plate 53 at the bottom of sub 52 closes the flow passage so that ingress is via inlets 56. Reduced section 35 blocks off the stinger bore 33 to the flow of fluid, which in the running-in state, exits through equalization ports 44. However, it will be recognized that when detachable member 34 is removed, the fluid stream containing detrital material flows vertically upwardly from the stinger, thus lessening the likelihood of detrital material setting out and plugging the stinger.

The upper end of the equalizing sub 42 is beveled as indicated by reference numeral 58 in order to facilitate the use of an overshot type fishing tool to retrieve the production stinger at the conclusion of the sand removal operation. A recessed section **54*a*** is also provided in order to facilitate grasping of the stinger by the overshot retrieval tool.

FIGS. 4, 5, 6 and 7 are schematic illustrations showing sequential stages in practicing the present invention. In the situation depicted in FIGS. 4, 5, 6 and 7, there is an accumulation of unwanted material 62 in the well. The accumulation 62 which may result from entry of unconsolidated material into the well in the course of normal production. More likely, the accumulation 62 may result from treatment of the well by hydraulic fracturing or acidizing. In this case, the particulate material 62 may take the form of propping agent or other particulates which accumulate in the well as a result of such stimulation procedures. As described above at the conclusion of the fracturing and/or acidizing procedure, the well is placed on production resulting in the flow of propping agent or other particulate material back from the formation into the well. In this case, the accumulated sand or other particulate material will also contain liquid resulting from the flow of fracturing fluid and/or formation fluids from the formation back into the well which will function in admixture with the propping sand to form an effective plug of the lower perforations.

In either situation, the normal practice will be to shut in the well and inject sufficient liquid down the tubing string to provide a kill liquid column in the well. The amount of liquid injected may be sufficient to impose a hydrostatic head in the well offsetting the downhole formation pressure or sufficient when added to the well head pressure to shut in the well. In either case, after the tubing string has been loaded with liquid indicated by reference numeral 60 in FIG. 4, the production stinger 31 is run into the well. As shown in FIG. 4, the production stinger is lowered through the tubing 28 on flexible cable 40 connected to the detachable section 34 at the top of the stinger. Liquid in the well bore flows into the inflow openings 56 upwardly through the stinger passage and outwardly through the equalization ports 44. The sliding seal member 46 and landing shoulder 50 of the stinger are shown schematicly in FIG. 4. As the stinger is lowered through the column of liquid and also after the stinger is in place as described later, the landing shoulder 50 below the sliding seal tends to protect it from sand, debris and the like which might cause damage to the seal.

Figure 5:
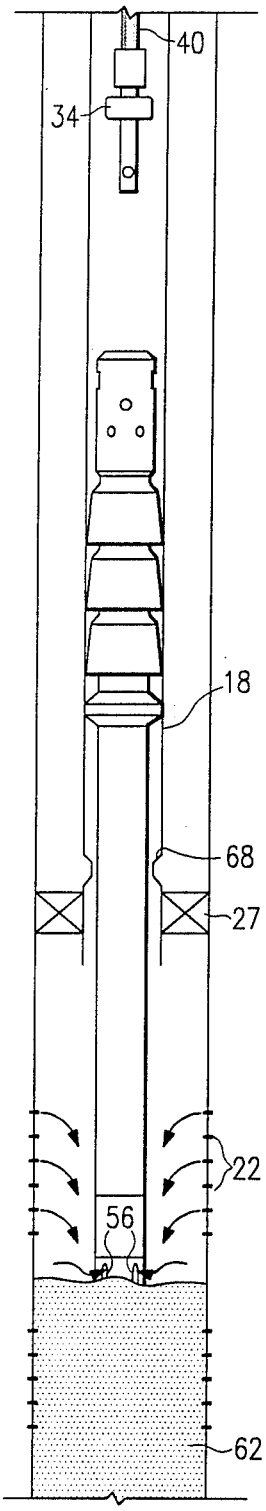

As shown in FIG. 5, the stinger is run into the well to a depth where the bottom of the stinger comes to rest upon the column of detrital material 62. At this point a sharp upward pull is asserted on cable 40 to separate the shear pin and the running-in cable is withdrawn. The well is placed on production, and the column of liquid above the sliding seal is removed. The well can be placed on production by running a swabbing operation to remove liquid from the tubing string. However, in many cases this will be unnecessary. The liquid can be removed simply by releasing the well head pressure so that the resulting "kick" causes the well to flow gas and liquid until the loading liquid is substantially removed from the tubing string.

Figure 6:
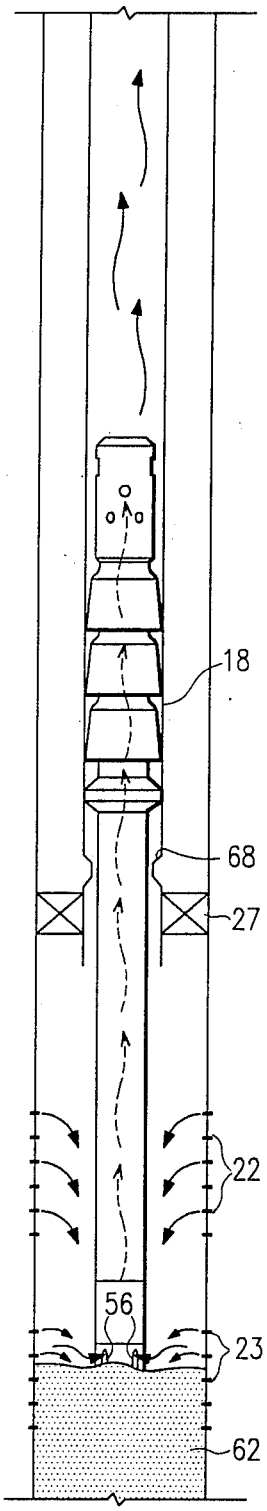
Figure 7:
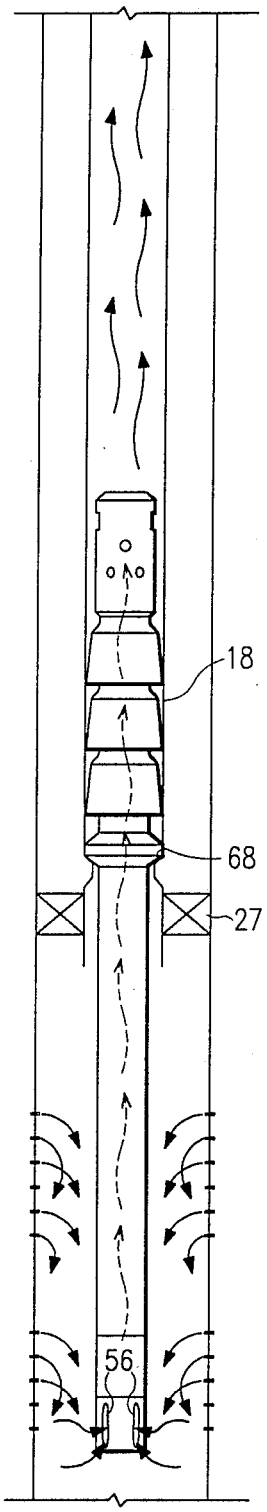

Upon removal of the detachable connecting section 34, the bore of the tubular member is open at its top thus permitting vertical flow through the top of the stinger. As gas enters from the formation through perforations 22, it flows into the inflow slots 56. The resulting turbulent flow regime immediately adjacent the inflow slots facilitates the gas picking up the sand and other particulate material and carrying it into the interior passage of the production stinger. The stinger resting on top of the sand accumulation is gradually lowered into the well under the influence of gravity. As shown in FIG. 6, the column of particulate material has been reduced, thus opening additional perforations 23 to the flow of gaseous fluid. FIG. 7 illustrates the final phase of the stinger's downward progression where the shoulder 50 is seated within a landing nipple 68 formed on the interior surface of the tubing. At this point, the production stinger can be withdrawn or, if desired, it can be left in place to cause the well to produce from the bottom of the open production interval and to ensure that additional detrimental material as it enters the well is recovered upwardly through the stinger rather than allowed to accumulate within the well. A configuration in which the stinger is closed at its bottom but provided with one or more slots in the wall of the nose section of the tubular member is advantageous in several respects. The closure of the bottom of the stinger prevents the tubing from digging into the accumulated material to an undesired depth. The likelihood of the bore of the stinger becoming clogged is materially reduced. In addition, by providing an elongated vertical slotlike configuration for the inflow openings, a margin of error is provided so that should the bottom of the stinger be embedded within the sand, there will be some remaining portion of the slot immediately adjacent the surface through which entrained particulate material flows.

The sliding seal 46 causes the sand-laden gaseous stream to flow upwardly through the stinger. The inverted cup configuration ensures that the positive pressure gradient from below to above the seal causes the sealing action to be enhanced with increasing pressure. At the same time the seating shoulder 50 tends to deflect any particulate material and prevent or at least retard erosion of the elastomeric sealing cups.

The practice of the present invention enables extremely long production intervals within a well to be open to the casing perforations. As an example of the practice of the present invention, a production stinger of the type embodied herein was run into a sanded up gas well producing from a production horizon comprising several gas sand formations at a depth of about 9,000 feet. The well had been hydraulicly fractured with a fracturing fluid containing sand as a propping agent. When the pressure gradient was reversed at the conclusion of the fracturing procedure, a substantial quantity of sand, mostly propping agent, flowed from the formation back into the well. The stinger was about 500 feet long. After the stinger was run into place and the well placed on production, it flowed a mixture of water, gas and sand for about 9 hours. Thereafter, sand and water production diminished substantially, and the well resumed normal gas production. After running a slick line testing device to confirm that the downhole production stinger had seated, it was estimated that a column of about 300 feet of sand had been remove from the well.

In many cases, the invention will be carried out in a well equipped with a packer set above the production interval as shown in FIGS. 5–7. When such a packer is present, a column of "packer fluid" or the like typically will be disposed in the tubing-casing annulus above the packer. However, the invention may be carried out in wells in which the tubing-casing annulus is open. Wells are often completed in this manner to permit stimulation procedures such as hydraulic fracturing to be carried through both the tubing and casing. In this case, the protocol depicted in FIGS. 5, 6 and 7 may be followed except a circulating fluid, preferably an inert gas such as nitrogen, can be circulated down the tubing-casing annulus and into the production interval where it picks up particulate material as described above. The fluid containing the entrained particulate material is then produced through the stinger and tubing similarly as in the case in which the natural well flow is employed. Alternatively, even though no packer is present, the natural well flow of fluid from the formation may be employed to remove the accumulated detrimental material. However, where the natural well flow is used, the packer does offer an advantage in limiting fluid flow to the bottom of the well where it effectively entrains the detrimental material.

After concluding the procedure with the stinger seated as shown in FIG. 7, the stinger can be withdrawn for use in another well. However, it often will be desirable to retain the stinger in the position shown in FIG. 7 in order to provide for production at the bottom of the well. This will guard against the accumulation of sand and other undesirable material in the well. Even where there is no sanding problem, the use of the stinger so that the inflow opening is located at least below the predominate portion of the casing perforations, preferably in the position shown in FIG. 7, may be advantageous. This is particularly so in the case of relatively tight gas formations in which water is present in the bottom of the well. The accumulation of water in the bottom of the well may be as a result of water production from the formation or a result of a stimulation procedure as described above. In any case, such water can seriously damage the formation. This problem may be particulary pronounced in relatively low permeability gas formations. The water enters into the formation from the well thus resulting in a decrease in the effective permeability of the formation to gas. Given the radial flow characteristics associated with such wells together with the already low natural permeability, water damage within the first few feet of the formation adjacent the well can seriously affect the gas production rate. By retaining the stinger as shown in FIG. 7 where it is adjacent, or preferably below the lower perforations, water can be withdrawn along with produced gas via the inlet slots 56, thus preventing the accumulation of water in sufficient amount to cover the lower perforations.

Having described specific embodiments of the present invention, it will be understood that modification thereof may be suggested to those skilled in the art, and it is intended to cover all such modifications as fall within the scope of the appended claims.

I claim:

1. In a method for the operation of a well penetrating a subterranean formation and having a production interval open to said formation through which gaseous fluids may be produced from said formation into said well and which is subject to the accumulation of particulate material within said well, said well having a tubing string extending to said production interval, the steps comprising:

(a) forming a production stinger by providing a nose sub having a longitudinal passage and at least one inflow opening providing ingress to said passage, securing an assemblage of a plurality of tubing joints having lengths of at least thirty feet to said nose sub, and securing a landing section including an annular seal slidable within the internal bore of said well tubing string to said assemblage of tubing stands to produce said production stinger, (b) lowering said production stinger through said tubing string until a portion of said stinger including said nose sub having said inflow opening protrudes from said well tubing string, said stinger establishing a longitudinal flow passage within said well extending to said production interval through said seal in said tubing string above said production interval;

(c) establishing a pressure gradient from said production interval into said longitudinal flow passage through said inflow opening placing said longitudinal flow passage in fluid communication with said production interval at a location adjacent the upper surface of a column of particulate material accumulated in said production interval;

(d) flowing gaseous formation fluid under said pressure gradient from said production interval into said longitudinal flow passage through said inflow opening, said fluid entraining particulate material from said accumulated particulate material and carrying said particulate material through said inflow passage and into said longitudinal passage to produce a fluid stream having particulate material entrained therein; and (e) flowing said fluid containing said entrained particulate material through said longitudinal flow passage and into said well tubing string above said seal as said production stinger is lowered through said tubing string seal.

2. The method of claim 1 wherein the fluid flowing from said well production interval through said inflow opening into said passage is in a turbulent flow condition at a location adjacent said inflow opening.

3. The method of claim 1 further comprising the step of progressively lowering said inflow opening as the accumulation of particulate material in said production interval is decreased to maintain said inflow opening adjacent the upper level of said column of accumulated material.

4. The method of claim 1 wherein said longtudinal flow passage is provided by a tubular stinger which is slidably disposed within a tubing string in said well and extends downwardly from said tubing string into said production interval, said well having a packer closing the annulus around said tubing string.

5. The method of claim 4 wherein said inflow opening is adjacent the lower end of said stinger and has a vertically elongated configuration in which the average vertical dimension is at least twice the average horizontal dimension.

6. The method of claim 4 wherein said tubular stinger has an open upper end to provide for straight-through vertical fluid flow from said stinger into said tubing string.

7. In a method for the operation of a well penetrating a subterranean hydrocarbon bearing formation, a production interval in said well open to said formation, a tubing string extending to said production interval, and a column of liquid in at least a portion of said tubing string, said well having a column of accumulated particulate material therein below the bottom of said tubing string, the steps comprising:

(a) running an elongated production stinger having a longitudinal passage into said well and downwardly through said tubing string;

(b) providing a sliding seal between said stinger and said tubing string as said stinger is lowered through said tubing string;

(c) providing for liquid flow from the exterior of said stinger through said longitudinal passage from below said seal to above said seal and then from said passage to the exterior of said stinger above said seal whereby liquid flows through said stinger passage as said stinger is lowered through said tubing to provide for pressure equalization above and below said seal;

(d) lowering a portion of said stinger through the mouth of said tubing string and into contact with the column of particulate material in said well to place at least one inflow opening for said particulate material extending from the exterior to the interior of said stinger adjacent the surface of said particulate material; and (e) placing said well on production to produce hydrocarbon fluids from said formation into said production interval and maintaining a pressure gradient through said at least one inflow opening to cause hydrocarbon fluids from said formation to entrain particulate material and pass into said inflow opening to produce a fluid stream having entrained particulate material therein which flows upwardly through said stinger and into said well tubing above said seal as said production stinger is lowered through said tubing string.

8. The method of claim 7 further comprising continuing the production of said well to reduce the amount of said particulate material in said well and moving said stinger downwardly through said tubing string as said particulate material is removed to retain said inflow opening in the vicinity of the top of the column of particulate material.

9. The method of claim 7 wherein liquid flow from said longitudinal passage in said stinger to the exterior of said stinger above said seal occurs through at least one equalization port above said sliding seal and wherein said longitudinal passageway is at least partially closed above said equalization port by an obstruction in said passageway during the running in of said production stinger, and further comprising the step of removing said obstruction so that after said well is placed on production, said fluid stream having entrained material therein flows vertically upward as it exits said stinger and passes into said tubing string.

10. The method of claim 7 wherein said inflow opening is of a vertically elongated configuration having a vertical dimension which is greater than the horizontal dimension of said opening.

11. The method of claim 10 wherein said stinger has a plurality of inflow openings of said vertically elongated configuration disposed circumferentially in the wall of said stinger.

12. In a method for the operation of a well penetrating a subterranean formation having a production interval in said well open to said formation, a casing, a tubing string within said casing extending downwardly through said well to said production interval and a column of accumulated particulate material in said well below the bottom of said tubing string, the steps comprising:

(a) running an elongated production stinger having a longitudinal passage therein into said well and downwardly through said tubing string from the surface of said well;

(b) providing a sliding seal between said stinger and said tubing string as said stinger is lowered through said tubing string in step (a);

(c) as said stinger is lowered through said tubing string in steps (a) and (b), providing for fluid flow from the exterior of said stinger through said longitudinal passage from below said sliding seal to above said sliding seal and then from said passage to the exterior of said stinger above said seal whereby fluid flow through said stinger passage as said stinger is lowered through said tubing provides for pressure equalization above and below said seal;

(d) lowering a portion of said stinger through the mouth of said tubing string and into contact with said column of particulate material in said well to place at least one inflow opening which extends from the exterior to the interior of said stinger, adjacent the surface of said particulate material;

(e) establishing a pressure gradient within said production interval extending from the exterior of said stinger through said at least one inflow opening into the interior of said stinger to cause fluid to flow from said production interval into said stinger along with particulate material from said column of accumulated particulate material to produce a fluid stream having entrained particulate material which flows upwardly through said stinger and into said well tubing above said seal; and (f) concomitantly with step (e) lowering said stinger while maintaining a sliding seal between said stinger and said tubing string as accumulated detrital material is removed.

13. The method of claim 12 wherein said pressure gradient is established by injecting a circulating fluid down the annulus between said tubing and casing and into said production interval to establish said pressure gradient and wherein said circulating fluid entrains said particulate material and passes into said inflow opening to produce said fluid stream having entrained particulate material therein.

14. The method of claim 12 wherein said formation is a gas producing formation and wherein said pressure gradient is established by placing said well on production to produce gaseous fluids from said formation into said production interval to cause said gaseous fluids to entrain said particulate material and pass into said inflow opening to produce said fluid stream having entrained particulate material.

15. In a method of producing a well penetrating a subterranean gas bearing formation and having a production interval in said well open to said formation and a tubing string extending down said well to said production interval, the steps comprising:

(a) producing fluid from said well with the flow of said fluid into said well from said formation carrying particulate material from said formation to cause an accumulation of a column of particulate material in the production interval of said well;

(b) shutting in said well and injecting liquid into said well in sufficient amount to form a liquid column in the production interval of said well and extending upwardly through at least a portion of said tubing string;

(c) running an elongated production stinger having a longitudinal passage into said well and downwardly through said tubing string and through the column of liquid within said tubing string;

(d) providing a sliding seal between said stinger and said tubing string as said stinger is lowered through said tubing string;

(e) providing for liquid flow from the exterior of said stinger through said longitudinal passage from below said seal to above said seal and then from said passage to the exterior of said stinger above said seal whereby liquid flows through said stinger passage as said stinger is lowered through said tubing to provide for pressure equalization above and below said seal;

(f) lowering a portion of said stinger through the mouth of said tubing string and into contact with the column of particulate material in said well to place at least one inflow opening for said particulate material extending from the exterior to the interior of said stinger adjacent the surface of said particulate material; and (g) removing the liquid previously introduced into said well from said well and placing said well on production to cause gas to flow from said formation into said production interval and maintaining a pressure gradient through said at least one inflow opening to cause the gaseous fluid from said formation to entrain particulate material and pass into said inflow opening to produce a fluid stream having entrained particulate material therein which flows upwardly through said stinger and into said well tubing above said seal as said production stinger is lowered through said tubing string.

16. The method of claim 15 further comprising continuing the production of said well to reduce the amount of said particulate material in said well and moving said stinger downwardly through said tubing string as said particulate material is removed to retain said inflow opening in the vicinity of the top of the column of particulate material.

17. The method of claim 15 wherein prior to Step (a) said well is subjected to a stimulation procedure involving the injection of a stimulating fluid down said well and into said formation and wherein at least a portion of the fluid flowing into said well from said formation is said stimulating liquid.

18. The method of claim 17 wherein said stimulating procedure is a hydraulic fracturing procedure involving the injection of hydraulic fracturing liquid containing propping agent down said well and into said formation and wherein at least a portion of the particulate material carried from the formation into said well comprises propping agent.

19. In the method of producing a well penetrating a subterranean gas bearing formation and having a production interval in said well open to said formation provided by a casing member having a plurality of vertically disposed perforations in said casing member and a tubing string extending down said well to said production interval, the steps comprising:

(a) providing an elongated production stinger having a longitudinal passage way therethrough in said tubing string, a portion of said stinger extending through the mouth of said tubing string and to a level in said well below at least the predominant portion of said perforations;

(b) providing a slidable seal between said stinger and said tubing string;

(c) providing an inflow opening in said stinger extending from said production interval of said well into the interior of said stinger at a level below at least the predominant portion of said perforations; and (d) flowing gaseous fluid from said formation through said perforations into said production interval and maintaining a pressure gradient through said at least one inflow opening to cause said gaseous fluid from said formation to flow into said inflow opening and carry accumulated detrimental material in said well upwardly through said stinger and into said well tubing above said seal as said production stinger is lowered through said tubing string.

20. The method of claim 19 wherein said detrimental material comprises water.

21. The method of claim 20 wherein said stinger has an open upper end for said longitudinal passageway to provide for straight through vertical fluid flow from said stinger into said tubing string.

22. The method of claim 7, wherein said production stinger is assembled at the surface of said well by securing an assemblage of a plurality of tubing joints having lengths of at least 30 feet to a nose sub in which said at least one inflow opening is located and securing a landing section including said sliding seal on the exterior thereof to said assemblage of tubing joints.

23. The method of claim 7, wherein said seal comprises a plurality of inverted sealing cups secured in tandem to the outer surface of said production stinger whereby a positive pressure gradient from below to above said seal causes the sealing action of said cups to be enhanced.

24. The method of claim 23, further comprising providing a shoulder upset from said production stringer below said sealing cups which moves in advance of said sealing cups as said stinger is moved through said tubing string.

25. The method of claim 12, wherein said fluid in step (e) is passed through said inflow opening in a vertically elongated flow profile.

26. The method of claim 12, wherein said production stinger is assembled at the surface of said well by securing an assemblage of a plurality of tubing joints having lengths of at least 30 feet to a nose sub in which said at least one inflow opening is located and securing a landing section including said sliding seal on the exterior thereof to said assemblage of tubing joints.

27. The method of claim 12, wherein said seal comprises a plurality of inverted sealing cups secured in tandem to the outer surface of said production stinger whereby a positive pressure gradient from below to above said seal causes the sealing action of said cups to be enhanced.

* * * * *